US005568238A

United States Patent [19]

Osbourne et al.

[11] Patent Number: 5,568,238

[45] Date of Patent: Oct. 22, 1996

[54] TRANSFER ASSIST APPARATUS HAVING A CONDUCTIVE BLADE MEMBER

[75] Inventors: William G. Osbourne; Julio A. Sanchez-Baños, both of Webster; Alan R. Anderson, Sodus, all of N.Y.

[73] Assignee: Xerox Corporation, Stamford, Conn.

[21] Appl. No.: 560,156

[22] Filed: Nov. 20, 1995

[51] Int. Cl.[6] ..... G03G 15/16

[52] U.S. Cl. ..... 355/274; 355/271; 355/277; 361/214

[58] Field of Search ..... 355/271, 273, 355/274, 277; 361/214, 220, 221, 222, 223

[56] References Cited

U.S. PATENT DOCUMENTS

| | | | |
|---|---|---|---|
| 4,947,214 | 8/1990 | Baxendell et al. | 355/274 |
| 5,091,751 | 2/1992 | Inoue et al. | 355/274 |
| 5,155,539 | 10/1992 | Yamaguchi et al. | 355/274 X |
| 5,300,993 | 4/1994 | Vetromile | 355/271 |
| 5,300,994 | 4/1994 | Gross et al. | 355/277 |

*Primary Examiner*—Arthur T. Grimley
*Assistant Examiner*—Sophia S. Chen
*Attorney, Agent, or Firm*—Denis A. Robitaille

[57] ABSTRACT

An apparatus which transfers a developed image from a photoconductive surface to a copy sheet. The apparatus includes a corona generating device arranged to charge the copy sheet for establishing a transfer field that is effective to attract the developed image from the photoconductive surface to the copy sheet and a blade which is moved from a non-operative position spaced from the copy sheet, to an operative position, in contact with the copy sheet for pressing the copy sheet into contact with at least the developed image on the photoconductive surface to substantially eliminate any spaces between the copy sheet and the developed image during transfer of the developed image from the photoconductive surface to the copy sheet. The blade is fabricated to include a conductive material for preventing the generation of electrostatic charge on the blade which may create copy quality defects as a lead edge of the copy sheet passes between the blade and the photoconductive surface.

10 Claims, 5 Drawing Sheets

TRANSFER ASSIST APPARATUS HAVING A CONDUCTIVE BLADE MEMBER

The present invention relates generally to an apparatus for assisting transfer of a developed image to a copy substrate in an electrostatographic printing machine, and more particularly concerns an apparatus utilized to enhance physical contact between the copy substrate and the developed image, wherein the apparatus includes a conductive blade member for eliminating image defects.

Generally, the process of electrostatographic copying is initiated by exposing a light image of an original document onto a substantially uniformly charged photoreceptive member. Exposing the light image onto the charged photoreceptive member discharges a photoconductive surface thereof in areas corresponding to non-image areas in the original document while maintaining the charge in image areas, thereby creating an electrostatic latent image of the original document on the photoreceptive member. Thereafter, developing material comprising charged toner particles is deposited onto the photoreceptive member such that the toner particles are attracted to the charged image areas on the photoconductive surface to develop the electrostatic latent image into a visible image. This developed image is then transferred from the photoreceptive member, either directly or after an intermediate transfer step, to an image support substrate such as a copy sheet, creating an image thereon corresponding to the original document. The transferred image is typically affixed to the image support substrate to form a permanent image thereon through a process called "fusing". In a final step, the photoconductive surface of the photoreceptive member is cleaned to remove any residual developing material thereon in preparation for successive imaging cycles.

The electrostatographic copying process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

The process of transferring charged toner particles from an image bearing member, such as the photoreceptive member, to an image support substrate, such as the copy sheet is accomplished at a transfer station, wherein the transfer process is enabled by electrostatically overcoming adhesive forces holding the toner particles to the image bearing member. In a conventional electrostatographic machine, transfer is achieved by transporting the image support substrate into the area of the transfer station where electrostatic force fields sufficient to overcome the forces holding the toner particles to the photoconductive surface are applied to attract and transfer the toner particles over onto the image support substrate. In general, such electrostatic force fields are generated via electrostatic induction using a corona generating device, wherein the copy sheet is placed in direct contact with the developed toner image on the photoconductive surface while the reverse side of the copy sheet is exposed to a corona discharge. This corona discharge generates ions having a polarity opposite that of the toner particles, thereby electrostatically attracting and transferring the toner particles from the photoreceptive member to the image support substrate. An exemplary corotron ion emission transfer system is disclosed in U.S. Pat. No. 2,836,725.

During electrostatic transfer of a toner image to a copy sheet, it is generally necessary, or at least desirable, for the copy sheet to be in uniform intimate contact with the photoconductive surface and the toner powder image developed thereon. Unfortunately, however, the interface between the photoreceptive surface and the copy substrate is not always optimal. In particular, non-flat or uneven image support substrates, such as copy sheets that have been mishandled, left exposed to the environment or previously passed through a fixing operation (e.g., heat and/or pressure fusing) tend to promulgate imperfect contact with the photoreceptive surface of the photoconductor. Further, in the event the copy sheet is wrinkled, the sheet will not be in intimate contact with the photoconductive surface and spaces or air gaps will materialize between the developed image on the photoconductive surface and the copy sheet where there is a tendency for toner not to transfer across these gaps, causing variable transfer efficiency and, in extreme cases, creating areas of low or no transfer, resulting in a phenomenon known as image transfer deletion. Clearly, an image transfer deletion is very undesirable in that useful information and indicia are not reproduced on the copy sheet.

As described, the typical process of transferring development materials in an electrostatographic system involves the physical detachment and transfer-over of charged toner particles from an image bearing photoreceptive surface into attachment with an image support substrate via electrostatic force fields. Thus, a very critical aspect of the transfer process is focused on the application and maintenance of high intensity electrostatic fields in the transfer region for overcoming the adhesive forces acting on the toner particles as they rest on the photoreceptive member. In addition, other forces, such as mechanical pressure or vibratory energy, have been used to support and enhance the transfer process. Careful control of these electrostatic fields and other forces is required to induce the physical detachment and transfer-over of the charged toner particles without scattering or smearing of the developer material.

The problem of transfer deletion has been addressed through various approaches. For example, an acoustic agitation system incorporating a resonator suitable for generating vibratory energy arranged in line with the back side of the photoconductor to apply uniform vibratory energy thereto has been disclosed in commonly assigned U.S. Pat. No. 5,081,500 as a method for enhancing toner release from the photoreceptive surface. In accordance with the concept of that patent, toner can be released from the image bearing surface of the photoconductor despite the fact that electrostatic charges in the transfer zone may be insufficient to attract toner over to the image support substrate.

Alternatively, mechanical devices, such as rollers or brushes, have been used to force the image support substrate into intimate and substantially uniform contact with the image bearing surface. For example, in the series 9000 family of electrophotographic printing machines manufactured by the Xerox Corporation, an electrically biased transfer roll system is effective in substantially eliminating image deletions. In other electrophotographic printing machines, such as the Model No. 1065 manufactured by the Xerox Corporation, the copy sheet is provided with a precisely controlled curvature as it enters the transfer station for providing enhanced contact pressure. These and other types of devices illustrating the background of this technology are discussed in U.S. Pat. No. 4,947,214 which discloses another alternative approach to transfer deletion problems that has actually been implemented in the Xerox Corporation Model No. 5090 Duplicator machine, among other products. In that machine, a flexible blade member is allowed to press against the copy sheet by means of a solenoid actuating device. The present invention is directed toward this general approach, wherein the above identified U.S. Patent may be relevant to various aspects of the present invention. In particular, the following patents may be relevant:

U.S. Pat. No. 4,947,214
Patentee: Baxendell, et al.
Issued: Aug. 7, 1990

U.S. Pat. No. 5,300,993
Patentee: Vetromile
Issued: Apr. 5, 1994

U.S. Pat. No. 5,300,994
Patentee: Gross et al.
Issued: Apr. 5, 1994

The relevant portions of the foregoing disclosure may be briefly summarized as follows:

U.S. Pat. No. 4,947,214 to Baxendell et al. discloses a system for transferring a developed image from a photoconductive surface to a copy sheet, including a corona generating device and a transfer assist blade. The blade is shifted via a solenoid-activated lever arm from a non-operative position spaced from the copy sheet, to an operative position, in contact with the copy sheet for pressing the copy sheet into contact with the developed image on the photoconductive surface to substantially eliminate any spaces therebetween during the transfer process. A practical implementation of that patent has been utilized with relative success in the Xerox Corporation model 5090 Duplicator.

U.S. Pat. No. 5,300,993 discloses another apparatus which transfers a developed image from a photoconductive surface to a copy sheet. The apparatus includes a corona generating device arranged to charge the copy sheet for establishing a transfer field that is effective to attract the developed image from the photoconductive surface to the copy sheet and a blade which is moved from a non-operative position spaced from the copy sheet, to an operative position, in contact therewith. The blade presses the copy sheet into contact with at least the developed image on the photoconductive surface to substantially eliminate any spaces between the copy sheet and the developed image during transfer of the developed image from the photoconductive surface to the copy sheet.

U.S. Pat. No. 5,300,994 discloses yet another apparatus for providing substantially uniform contact between a copy substrate and a developed image located on an imaging member. The structure of that invention comprises contact means, adapted to move from a non-operative position spaced from the imaging member to an operative position in contact with the copy substrate on the imaging member, for applying pressure against the copy substrate in a direction toward the imaging member, and means, including an elevated deflecting surface, for applying a load to the contact means to deflect the contact means into the operative position.

Although transfer assist apparatus of the type described in the above-identified patents have been implemented in printing machines sold on the market today, it has been found that such apparatus may induce copy quality defects in the lead edge area of the copy sheet. It has been further determined that electrostatic interaction may occur between the transfer blade member and the copy sheet, due to a measurable electrostatic charge imparted on the blade member by the transfer corona generating device. This electrostatic charge creates a tack force between the blade member and the copy sheet which is greater than the tack force between the copy sheet and the photoreceptor, which, in turn, generates a velocity mismatch between the copy sheet and the photoreceptor, manifesting itself as a smeared image on the lead edge of the copy sheet. This lead edge image defect is unacceptable in most high speed environments where customers demand lead edge to trail edge copy quality as the electrostatographic printing process penetrates further in to the offset printing market.

In accordance with the present invention, there is provided an apparatus for transferring a developed image from an image bearing surface to a copy sheet, including: means for electrostatically charging the copy sheet to attract the developed image from the image bearing surface to the copy sheet; and means for pressing the copy sheet into contact with at least the developed image on the image bearing surface in a region proximate to the charging means for substantially eliminating any spaces between the copy sheet and the developed image, wherein the pressing means includes a substantially conductive blade member for substantially preventing build-up of electrostatic charge thereon.

Pursuant to another aspect of the present invention, there is provided an electrostatographic printing machine of the type in which a developed image is transferred from a photoconductive surface to a copy sheet at a transfer station, comprising: means for electrostatically charging the copy sheet to attract the developed image from the photoconductive surface to the copy sheet; and means for pressing the copy sheet into contact with at least the developed image on the photoconductive surface in a region proximate to the charging means for substantially eliminating any spaces between the copy sheet and the developed image, wherein the pressing means includes a substantially conductive blade member for substantially preventing build-up of electrostatic charge thereon.

Other aspects of the present invention will become apparent as the following description proceeds and upon reference to the drawings, in which.

Figure 4:
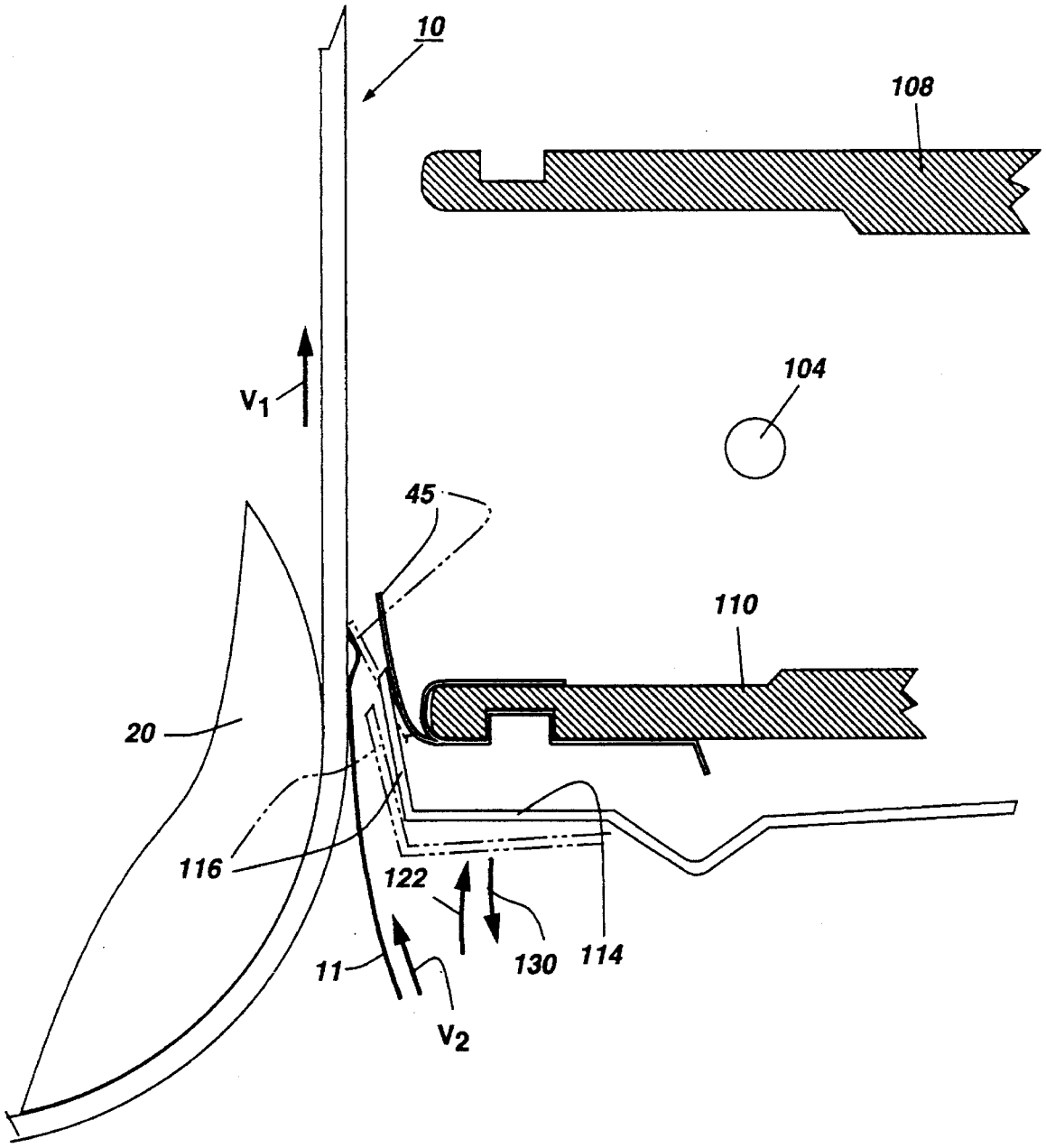
Figure 5:
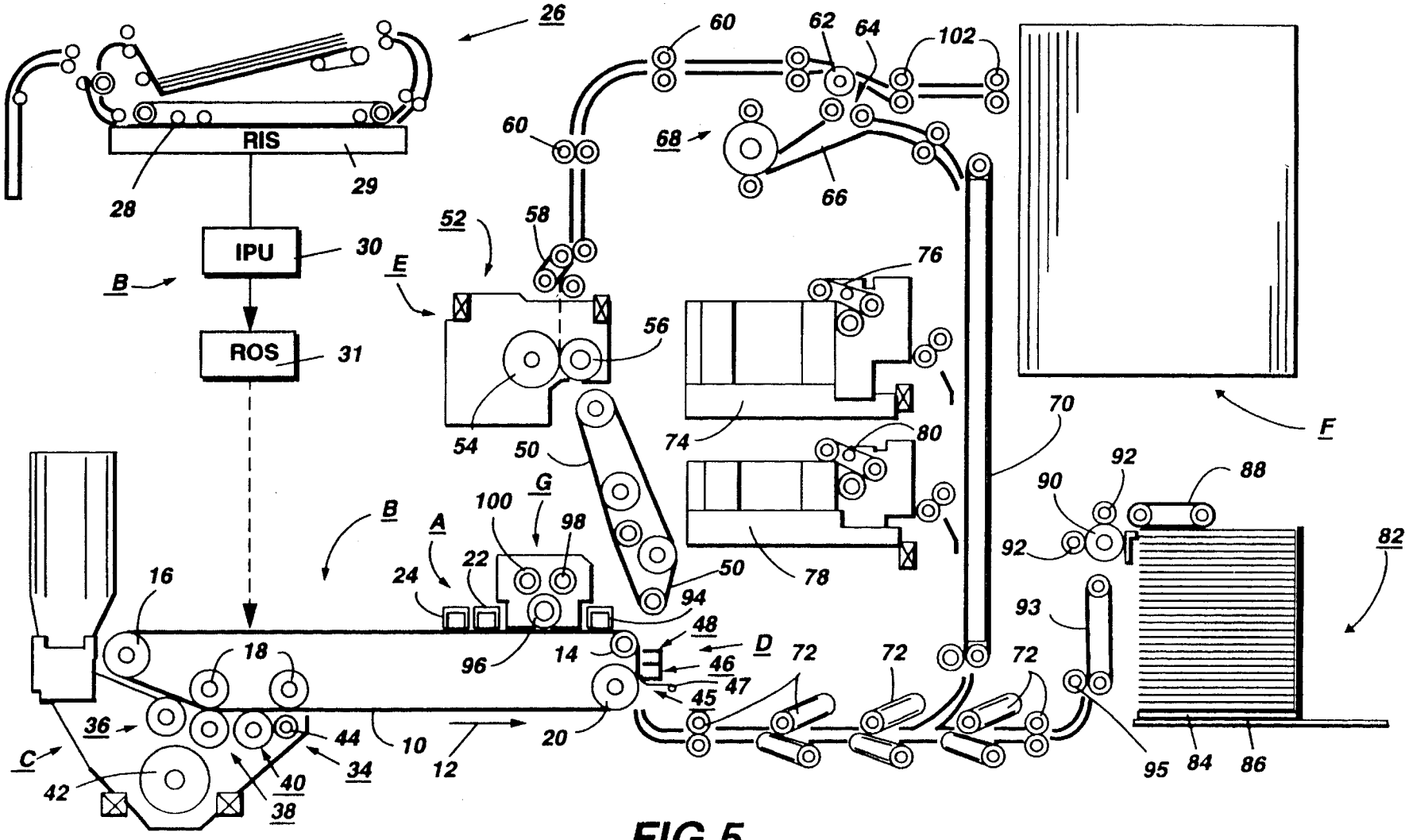

FIG. 4 is an enlarged elevational view depicting the problem presented by velocity mismatch between the copy sheet and the photoreceptor to which the present invention is directed, and the conductive transfer assist blade member in accordance with the present invention; and FIG. 5 is a schematic elevational view depicting an illustrative electrophotographic printing machine incorporating transfer assist apparatus in accordance with the present invention therein.

While the present invention will hereinafter be described in connection with a preferred embodiment and method of use, it will be understood that it is not intended to limit the invention to that embodiment or method of use. On the contrary, the following description is intended to cover all alternatives, modifications, and equivalents, as may be included within the spirit and scope of the invention as defined by the appended claims. Other aspects and features of the present invention will become apparent as the following description progresses.

For a general understanding of the features of the present invention, reference is made to the drawings, wherein like reference numerals have been used throughout to identify identical or similar elements. Turning initially to FIG. 5 prior to discussing the invention in detail, a schematic depiction of an exemplary electrophotographic reproducing machine incorporating various machine components is furnished in order to provide a general background and understanding of the features of the present invention. Although the apparatus of the present invention is particularly well adapted for use in an automatic electrostatographic printing machine as shown in FIG. 5, it will become apparent from the following discussion that the transfer assist blade apparatus of the present invention is equally well suited for use in a wide variety of electrostatographic processing machines as well as many other known printing systems. It will be further understood that the present invention is not necessarily limited in its application to the particular embodiment or embodiments shown and described herein.

The exemplary electrostatographic printing machine of FIG. 5 employs a photoconductive belt 10, preferably comprising a photoconductive material coated on a ground layer, which, in turn, is coated on an anti-curl substrate. The photoconductive material includes a transport layer, which typically contains small molecules of di-m-tolydiphenylbiphenyldiamine dispersed in a polycarbonate, coated on a generator layer, generally made from trigonal selenium while the grounding layer is made from a titanium coated Mylar. Of course, other suitable photoconductive materials, ground layers, and anti-curl substrates may also be employed. Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by any suitable means such as a drive belt. Thus, as roller 20 rotates, it advances belt 10 in the direction of arrow 12 to advance successive portions of the photoconductive surface sequentially through the various processing stations disposed about the path of movement thereof.

Initially, a portion of photoconductive belt 10 passes through charging station A whereat two corona generating devices, indicated generally by the reference numerals 22 and 24 charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas missed by corona generating device 22.

Next, the charged portion of photoconductive belt 10 is advanced through imaging station B. At imaging station B, a document handling unit, indicated generally by reference numeral 26, is positioned over platen 28 of the printing machine. The document handling unit 26 sequentially feeds documents from a stack of documents placed in a document stacking and holding tray such that the original documents to be copied are loaded face up into the document tray on top of the document handling unit. Using this system, a document feeder, located below the tray, feeds the bottom document in the stack to rollers for advancing the document onto platen 28 by means of a belt transport which is lowered onto the platen with the original document being interposed between the platen and the belt transport. When the original document is properly positioned on platen 28, the document is imaged and the original document is returned to the document tray from platen 28 by either of two paths. If a simplex copy is being made or if this is the first pass of a duplex copy, the original document is returned to the document tray via a simplex path. If this is the inversion pass of a duplex copy, then the original document is returned to the document tray through a duplex path.

Imaging of the document is achieved by a scanning assembly, preferably comprising a Raster Input Scanner (RIS) 29 for capturing the entire image from the input document and converting the image into a series of raster scan lines corresponding to individual picture elements or so-called pixels making up the original input document. The output signal of the RIS 29 is transmitted as an electrical signal to an Image Processing Unit (IPU) 30 where they are converted into an individual bitmap representing the receptive values of exposure for each pixel. The IPU 30 can store bitmap information for subsequent imaging or can operate in a real time mode. The digital output signal generated by the IPU 30 is transmitted to a Raster Output Scanner (ROS) 31 for writing the image bitmap information onto the charged photoreceptive belt 10 by selectively erasing charges thereon in a pixel-by-pixel manner. It should be noted that either discharged area development (DAD) discharged portions are developed, or charged area development (CAD), wherein charged areas are developed can be employed, as known in the art. This process records an electrostatic latent image on photoconductive belt 10 corresponding to the informational areas contained within the original document. Thereafter, photoconductive belt 10 advances the electrostatic latent image recorded thereon to development station C.

At development station C, a magnetic brush developer housing, indicated generally by the reference numeral 34, is provided, having three developer rolls, indicated generally by the reference numerals 36, 38 and 40. A paddle wheel 42 picks up developer material in the developer housing and delivers the developing material to the developer rolls. When the developer material reaches rolls 36 and 38, it is magnetically split between the rolls with approximately half of the developer material being delivered to each roll. Photoconductive belt 10 is partially wrapped about rolls 36 and 38 to form an extended development zones. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet (not shown) is moved into contact with the toner powder image on belt 10. The developed image on belt 10 contacts the advancing sheet of support material in a timed sequence and is transferred thereon at transfer station D. As can be seen in the illustrated embodiment, a corona generating device 46 charges the copy sheet to a proper potential so that the sheet is electrostatically secured or "tacked" to belt 10 and the toner image thereon is attracted to the copy sheet. As previously discussed, it is not uncommon for air gaps or spaces to exist between the copy sheet and the surface of the belt 10 at the transfer station. For example, some publishing applications require imaging onto high quality papers having surface textures which prevent intimate contact of the paper with the developed toner images. In duplex printing systems, even initially flat paper can become cockled or wrinkled as the result of the first side fusing step. Also, color images can contain areas in which intimate contact of toner with paper during the transfer step is prevented by adjacent areas of high toner pile heights. The lack of uniform intimate contact between the belt and the copy sheet in these situations can inhibit transfer and may result in image deletions, i.e., image areas where transfer has failed to occur.

In accordance with the present invention, the interface between the sheet feeding apparatus and transfer station D includes an apparatus for applying uniform contact pressure to the sheet as it is advanced onto belt 10. As such, the copy sheet is advanced along a sheet path between a pair of baffle members and pressed into contact with the toner powder image on photoconductive surface 10 by a transfer assist blade, indicated generally by the reference numeral 45. Contact assisted transfer, as provided by the present invention, is a technique that helps reduce the occurrence of such deletions by using a blade member to contact the back side of a copy sheet for creating intimate contact between the copy sheet and the photoreceptor belt 10, thereby eliminating or minimizing the forces that retard toner migration toward the copy substrate. In addition, such uniform intimate contact provides increased transfer efficiency with lower than normal transfer fields, which not only yields better copy quality, but also results in improved toner use efficiency as well as a reduced load on the cleaning system.

The precise timing of the entrance of a copy sheet into the transfer station D is determined by a registration synchronization signal from the imaging system, which is then processed by a circuit for controlling the actuation of blade 45. Blade 45 is moved from a non-operative position, spaced from the copy sheet and the photoconductive belt 10 to an operative position in contact with the back side of the copy sheet. A mechanical transport mechanism such as a solenoid, indicated generally by reference numeral 47, move blade 45 between the operative and non-operative positions. In the operative position, blade 45 presses the copy sheet into contact with the toner powder image developed on photoconductive belt 10 for substantially eliminating any spaces between the copy sheet and the toner powder image such that the continuous pressing of the sheet into contact with the toner powder image at the transfer station insures that the copy sheet is in substantially intimate contact with the belt 10. In addition, corona generating device 46 charges the copy sheet to the proper magnitude and polarity so that the copy sheet is tacked to photoconductive belt 10 and the toner powder image is attracted from the photoconductive belt to the copy sheet. Thereafter, the copy sheet moves with photoconductive belt 10, in the direction of arrow 12. As the trailing edge of the copy sheet passes a light sensor (not shown), the light sensor transmits a signal to a processing circuit which deenergizes the solenoids 47 for shifting the blade 45 to its non-operative position. In the non-operative position, blade 45 is spaced from the copy sheet and the photoconductive belt, insuring that blade 45 does not scratch the photoconductive belt or accumulate toner particles thereon which may be deposited on the backside of the next successive copy sheet. An exemplary type of light sensor and delay circuit is described in U.S. Pat. No. 4,341,456 issued to Iyer et al. in 1982, the relevant portions thereof being hereby incorporated into the present application. Further details of the transfer assist blade member in accordance with the present invention will be described hereinafter with reference to FIGS. 1 to 4.

Continuing now with a general description of the electrostatographic printing process, after image transfer, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller 56 abuts the fuser roller 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F via rollers 102 or to inverter 66. In the finishing station, the copy sheets are collected in sets and the copy sheets of each set can be stapled or glued together. Alternatively, duplex solenoid gate 64 diverts the sheet into inverter 66, providing intermediate storage for one sheet which has been printed on one side and on which an image will be subsequently printed on the second, opposed side thereof, i.e. the sheet being duplexed. In order to complete duplex copying, the simplex sheet in inverter 66 is fed by a feed roll 68 from inverter 66 back to transfer station D, via conveyor 70 and rollers 72, for transfer of the toner powder image to the opposite side of the copy sheet. Once again blade 45 is actuated and moved from the non-operative position to the operative position during the transfer process. After the copy sheet exits the transfer station, blade 45 is actuated once again and returned to the non-operative position. The duplex sheet is then fed through the same path as the simplex sheet to be advanced to finishing station F.

Copy sheets may also be fed to transfer station D from a secondary tray 74 or auxiliary tray 78, which includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by a sheet feeder 76 or 80 comprising a friction retard feeder utilizing a feed belt and take-away rolls to advance successive copy sheets to transport 70 which advances the sheets to rolls 72 and then to transfer station D.

Secondary tray 74 and auxiliary tray 78 represent supplemental sources of copy sheets. However, a high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

Invariably, after the copy sheet is separated from photoconductive belt 10, some residual particles remain bonded thereto. After transfer, photoconductive belt 10 passes beneath yet another corona generating device 94 which charges the residual toner particles to the proper polarity for breaking the bond between the toner particles and the belt. Thereafter, a pre-charge erase lamp (not shown), located inside the loop formed by photoconductive belt 10, discharges the photoconductive belt in preparation for the next charging cycle. Residual particles are removed from the photoconductive surface at cleaning station G. Cleaning station G includes an electrically biased-cleaner brush 96 and two waste and reclaim de-toning rolls 98 and 100. The reclaim roll 98 is electrically biased negatively relative to the cleaner roll 96 so as to remove toner particles therefrom while the waste roll 100 is electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

The various machine functions are regulated by an electronic subsystem (ESS) controller (not shown) which is preferably a programmable microprocessor capable of managing all of the machine functions hereinbefore described. Among other things, the controller provides a comparison count of the copy sheets, the number of documents being recirculated, the number of copy sheets selected by the operator, time delays, jam indications and transfer assist blade actuation signals. Conventional sheet path sensors or switches may be utilized to keep track of the position of documents and the sheets in the machine. In addition, the controller regulates the various positions of gates and switching depending upon the mode of operation selected.

The foregoing description should be sufficient for the purposes of the present application for patent to illustrate the general operation of an electrostatographic printing apparatus incorporating the features of the present invention. As previously discussed, the electrophotographic reproducing apparatus may take the form of any of several well known devices or systems including various printing machines manufactured by Xerox Corporation such as models 4135 and Docutech DT90 and DT135 as well as future products. Variations of specific electrostatographic processing subsystems or processes may be expected without affecting the operation of the present invention.

Figure 1:
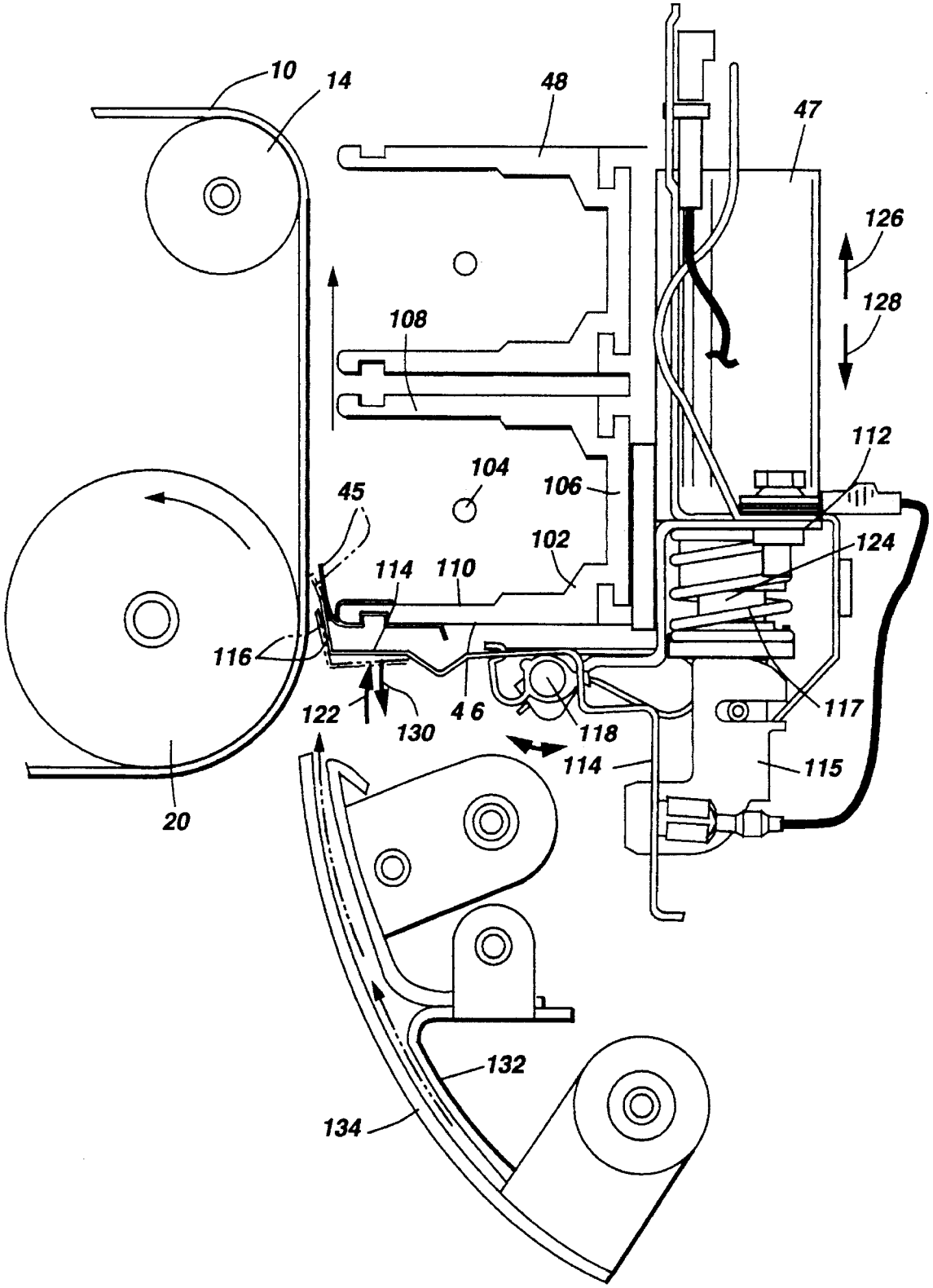
FIG. 1 is an elevational side view showing a transfer assist blade of the type which may be utilized in an electrostatographic printing machine to press a copy sheet against a developed image on a photoconductive surface.
Figure 2:
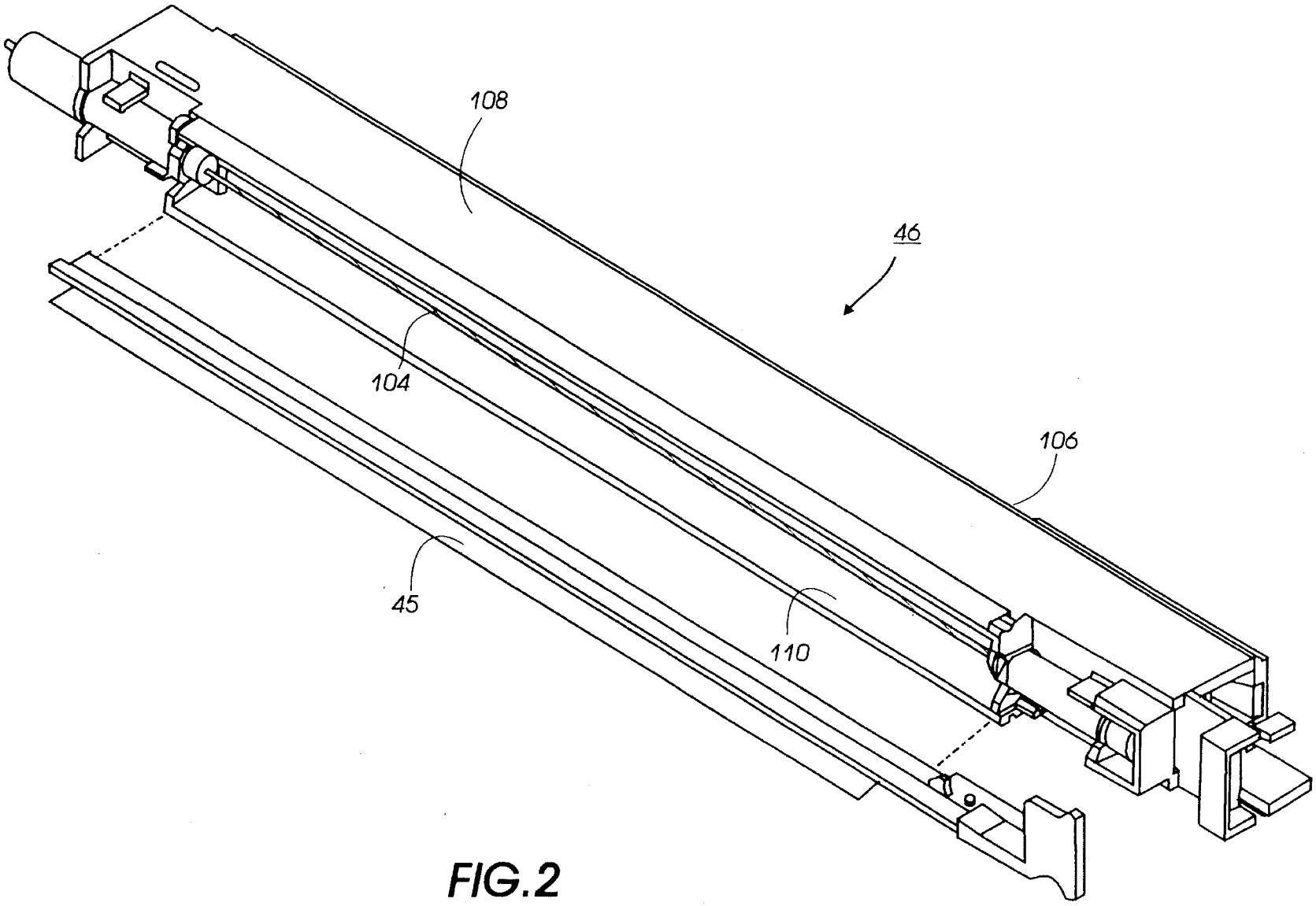
FIG. 2 is a perspective view illustrating the removable transfer assist blade and corona generating device of the present invention.

Moving now to FIGS. 1 to 4, the particular features of the transfer assist apparatus of the present invention will be described in greater detail. With specific reference to FIG. 1, the transfer assist apparatus is depicted in an elevational view to more clearly reveal the various components included therein. As shown in this Figure, baffle members 132 and 134 direct a copy substrate (not shown) toward photoconductive belt 10 at transfer station D. Corona generating device 46, situated at the transfer station, includes a generally U-shaped shield, indicated generally by the reference numeral 102, partially surrounding an elongated electrode wire 104. Shield 102 has a back wall 106 and a pair of opposed, spaced side walls 108 and 110 secured thereto. A typical corona generating device including a corona generating electrode is shown in FIG. 2, wherein it will be understood by those of skill in the art that the corona generating device 46 provides a means for charging the copy sheet at the transfer station to attract the toner powder image from the photoconductive belt 10 to the copy sheet. One skilled in the art will appreciate that any suitable corona generating device may be employed, as for example, a corona generator having an electrode which is comprised of spaced pins, or a shield which may be limited to a pair of side walls having no back wall.

As previously discussed, the transfer assist assembly of the present invention includes a transfer assist blade 45 for pressing the sheet into intimate contact with the toner powder image on photoconductive belt 10. As shown in FIG. 2, a marginal region of blade 45 is removably secured to the free marginal end region of side wall 110 such that the opposite end of the blade 45 protrudes beyond side wall 110 in the direction of the photoreceptor 10 surface. In this way, blade 45 continuously exerts a force toward photoconductive belt 10. This force is opposed by end 116 of lever arm 114 for holding the blade 45 away from the surface of the photoreceptor 10, as will be described.

A lever arm 114 is mounted adjacent to blade 45, having a free end 116 which contacts blade 45 along the protruding segment thereof. The opposite end of lever arm 114 is secured via pivot arm 115 to a solenoid 47 which, in turn, is mounted to bracket 112 secured to back wall 106. Lever arm 114 is adapted to be pivoted along a central portion thereof about pivot pin 118 such that energization of solenoid 47 pulls plunger 124 thereof in the direction of arrow 126, toward the body of the solenoid, so as to pivot the lever arm 114 about pivot pin 118 in a counter clockwise direction as shown by arrow 130. Since lever arm 114 pivots about point 118, end 116 is moved in the direction of arrow 130, permitting blade 45 to flex or pivot toward the surface of the photoreceptor and into an operative position against the back of the copy sheet. Conversely, when the solenoid 47 is de-energized, the plunger 124 is caused to move in the direction of arrow 128, urged in that direction via return spring 117, such that free end 116 of lever arm 114 is now moved in the direction of arrow 122, causing blade 45 to be deflected away from the surface of the photoreceptor 10, to a non-operative position.

In operation, baffles 132 and 134 guide the copy sheet into the transfer station. The controller transmits a signal to energize the solenoid 47. Energization of the solenoid 47 translates plunger 124 in the direction of arrow 126, pivoting lever arm 114 about pivot point 118 such that the free end 116 of lever arm 114 shifts in the direction of arrow 130. As a result, blade 45 moves from the deflected, non-operative position to the undeflected, operative position, wherein the free end of blade 45 contacts the back of the copy sheet and presses the copy sheet against the developed toner powder image on photoconductive belt 10. This substantially eliminates any spaces between the copy sheet and the toner powder image, thereby enhancing the transfer of the toner powder image to the copy sheet such that the toner powder image transferred to the copy sheet is substantially deletion free. After transfer is completed, a light sensor detects the trailing edge of the copy sheet, and, after a suitable delay, the controller transmits a deenergizing signal to the solenoid 47. Deenergization of solenoid 47 causes end 116 of lever arm 114 to shift in the direction of arrow 122, thereby contacting, blade 45 and deflecting it from the operative position to the non-operative position, away from the surface of the photoreceptor. Thus, as the copy sheet passes out of the transfer station, lever arm 114 pivots free end 116 in the direction of blade 45 to lift the blade 45 away from the copy sheet so that the blade 45 does not come in direct contact with the photoconductive surface.

Figure 3:
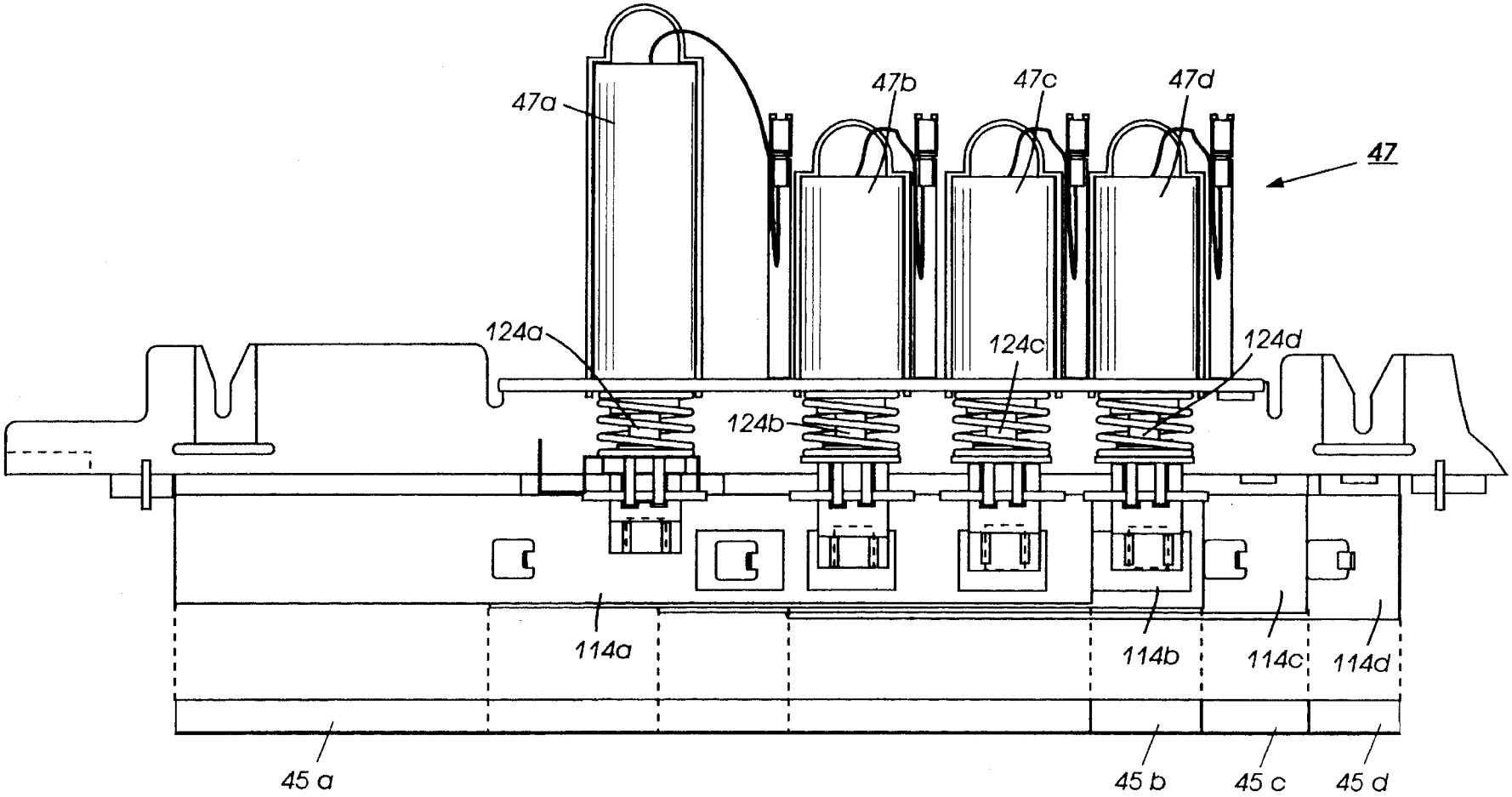
FIG. 3 is a plan view illustrating the transfer assist blade and actuation mechanism of FIG. 1.

Turning now to FIG. 3, a multiple member transfer assist blade of the type which may be used in machines capable of making output or prints on various sizes of copy sheets is shown in greater detail. As shown thereat, lever arm 114 includes portions 114*a*, 114*b*, 114*c* and 114*d*. Accordingly, blade member 45 includes portions 45*a*, 45*b*, 45*c* and 45*d*. Solenoid 47 includes solenoid 47*a* having plunger 124*a* connected to lever arm 114*a* which acts on blade portion 45*a*, solenoid 47*b* having plunger 124*b* connected to lever arm 114*b* which acts on blade portion 45*b*, solenoid 47*c* having plunger 124*c* connected to lever arm 114*c* which acts on blade portion 45*c* and solenoid 47*d* having plunger 124*d* connected to lever arm 114*d* which acts on blade portion 45*d*. Thus, energization of solenoid 47*a* moves blade portion 45*a* from the non-operative position to the operative position with blade portions 45*b*, 45*c* and 45*d* remaining at the non-operative position. In this embodiment for example, if the copy sheet is 8½×11 inches, only solenoid 47*a* is energized, so that only blade portion 45*a* moves from the non-operative position to the operative position. By contrast, if the copy sheet is 8½×14 inches, solenoids 47*a*, 47*b*, 47*c* and 47*d* are energized. In like manner, energization of selected solenoids moves corresponding blade portions between the non-operative position to the operative position, depending on the size of the copy sheet, as may be determined through operator input or by the use of sensors.

A prevailing deficiency has been encountered in prior art systems using a transfer assist blade system of the type described. For example, a commercial embodiment of the invention disclosed by U.S. Pat. No. 4,947,214, issued to Baxendell et al., incorporated by reference herein, wherein a transfer assist blade is periodically shifted between the operative and the non-operative positions, is presently incorporated in the Xerox Corporation model 5090 copying machine. In that machine, blade 45 is fabricated from a thin, flexible, insulative sheet material such as a polyester film which is elastically deformable to an accurate shape. One example of such a material is MYLAR® a tradename and registered trademark for a specific polyester film A, available from E.I. DuPont de Nemours and Company of Wilmington, Del. It has been found that products which presently utilize this type of blade to suppress transfer deletions are subject to a copy quality defect in the lead edge area of the copy sheet, whereby image smear occurs due to the interaction of the transfer blade and the copy sheet. The nature of the problem is illustrated in FIG. 4, where it is depicted that some interaction may occur between the transfer blade member 45 and the copy sheet 11, caused by a measurable electrostatic charge imparted on the blade member 45 by the transfer corona generating electrode 104. This electrostatic charge creates a tack force between the blade member 45 and the copy sheet 11 which is greater than the tack force between the copy sheet 11 and the photoreceptor 10, which, in turn, generates a velocity mismatch between the copy sheet 11 and the photoreceptor 10. This phenomenon is shown diagramatically in FIG. 4, wherein the photoreceptor 10 travels at velocity $V_1$, while the lead edge of the copy sheet 11 travels at a velocity $V_2$ at the point of initial contact with blade 45. The problem manifests itself as a smeared image on the lead edge of the copy sheet 11. This lead edge image defect is unacceptable in most high speed environments demanding lead edge to trail edge copy quality.

As a solution to the problem discussed hereinabove, the present invention contemplates a transfer assist apparatus, wherein the blade member 45 is fabricated to include a conductive material for preventing static build up thereon. By providing a blade that is conductive, the generation of an electrostatic charge thereon is eliminated, or at least minimized such that any charge that develops is lesser than the charge generated on the photoreceptor during transfer. One exemplary material which has been found to provide desirable results is the MYLAR® Type 848 anti-static film available from E.I. DuPont de Nemours and Company of Wilmington, Del., having a nominal thickness between approximately 94 and 160 microns. This anti-static film material is characterized by two-sided chemically treated surfaces for reducing static generation, having a surface resistivity of $1.5\times10^1$ ohms/square (at 72° F. and 40% RH). It has been found that this material provides optimal surface conductivity properties in the high-speed electrostatographic process described herein. It will be understood by those of skill in the art that this material represents only one of many possible materials which may be utilized in solving the problem which is addressed by the present invention such that the invention is directed more generally to a blade member including a substantially flexible sheet material adapted to be shifted between a non-operative position spaced from the image bearing surface, and an operative position in contact with the copy sheet on the image bearing surface, wherein the includes an anti-static material for reducing static generation.

In review, the transfer apparatus of the present invention includes a blade member, normally spaced from the photoconductive surface, in the non-operative position, which is moved to an operative position for pressing the copy sheet into intimate contact with the toner powder image developed on the photoconductive belt by the action of a solenoid. The blade member includes a conductive material for preventing static buildup thereon to eliminate the generation of electrostatic charge on the blade which may induce image quality defects on the copy sheet as it passes through the transfer station. It will be appreciated that the transfer assist blade system disclosed herein may include multiple segments which may be selectively moved to provide contact across the various widths of standard size copy sheets in a xerographic printing machine. It will further be appreciated that the transfer assist blade described herein may be advantageously shifted between the operative and non-operative positions by some mechanism other than a solenoid, such as a stepper motor, a rotary solenoid, etc.

It is, therefore, evident that there has been provided, in accordance with the present invention, an apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for transferring a developed image from an image bearing surface to a copy sheet, including:

means for electrostatically charging the copy sheet to attract the developed image from the image bearing surface to the copy sheet; and means for pressing the copy sheet into contact with at least the developed image on the image bearing surface in a region proximate to said charging means for substantially eliminating any spaces between the copy sheet and the developed image;

said pressing means including a substantially conductive blade member including a substantially flexible sheet material adapted to be shifted between a non-operative position spaced from the image bearing surface, and an operative position in contact with the copy sheet on the image bearing surface, the sheet material including an anti-static material for reducing static generation to substantially prevent build-up of electrostatic charge thereon;

a lever member, pivotable about a pivot point, for shifting said blade member between the non-operative position and the operative positions; and a transport member coupled to said lever member for selectively pivoting said lever member about said pivot point to effect the shifting of said blade member between the non-operative position and the operative position.

2. The apparatus of claim 1, wherein said blade member has a surface resistivity of approximately $1.5\times10^{1}$ ohms/square.

3. The apparatus of claim 1, wherein said blade member has a nominal thickness between approximately 94 and 160 microns.

4. The apparatus of claim 1, wherein said charging means includes a corona generating device spaced from the image bearing surface to define a gap therebetween through which the copy sheet passes.

5. The apparatus of claim 4, wherein one marginal region of said blade member is removably mounted on said corona generating device.

6. An electrostatographic printing machine of the type in which a developed image is transferred from a photoconductive surface to a copy sheet at a transfer station, comprising:

means for electrostatically charging the copy sheet to attract the developed image from the photoconductive surface to the copy sheet; and means for pressing the copy sheet into contact with at least the developed image on the photoconductive surface in a region proximate to said charging means for substantially eliminating any spaces between the copy sheet and the developed image;

said pressing means including a substantially conductive blade member including a substantially flexible sheet material adapted to be shifted between a non-operative position spaced from the image bearing surface, and an operative position in contact with the copy sheet on the image bearing surface, the sheet material including an anti-static material for reducing static generation to substantially prevent build-up of electrostatic charge thereon;

a lever member, pivotable about a pivot point, for shifting said blade member between the non-operative position and the operative positions; and a transport member coupled to said lever member for selectively pivoting said lever member about said pivot point to effect the shifting of said blade member between the non-operative position and the operative position.

7. The electrostatographic printing machine apparatus of claim 6, wherein said blade member has a surface resistivity of approximately $1.5\times10^{1}$ ohms/square.

8. The electrostatographic printing machine apparatus of claim 6, wherein said blade member has a nominal thickness between approximately 94 and 160 microns.

9. The electrostatographic printing machine of claim 6, wherein said charging means includes a corona generating device spaced from the photoconductive surface to define a gap therebetween through which the copy sheet passes.

10. The electrostatographic printing machine of claim 9, wherein one marginal region of said blade member is removably mounted on said corona generating device.

* * * * *